US007179208B1

(12) United States Patent
Nalley

(10) Patent No.: US 7,179,208 B1
(45) Date of Patent: Feb. 20, 2007

(54) WEIGHT PLATE WITH EXTERNALLY ACTUATED INTERNAL LOCKING DEVICE

(76) Inventor: Mark Nalley, 41373 Avenida Delores, Murrieta, CA (US) 92562-7368

( * ) Notice: Subject to any disclaimer, the term of this patent is extended or adjusted under 35 U.S.C. 154(b) by 490 days.

(21) Appl. No.: 10/868,065

(22) Filed: Jun. 16, 2004

(51) Int. Cl.
*A63B 21/06* (2006.01)

(52) U.S. Cl. ..... 482/99; 482/98

(58) Field of Classification Search ..... 482/104–108, 482/98, 99, 102, 93, 133–137, 908
See application file for complete search history.

(56) References Cited

U.S. PATENT DOCUMENTS 4,610,449 A * 9/1986 Diercks, Jr. ..... 482/98
4,627,615 A * 12/1986 Nurkowski ..... 482/98
5,306,221 A * 4/1994 Itaru ..... 482/98
5,556,362 A * 9/1996 Whipps ..... 482/98
6,174,265 B1 * 1/2001 Alessandri ..... 482/5
6,468,189 B2 * 10/2002 Alessandri ..... 482/99

* cited by examiner

*Primary Examiner*—Jerome Donnelly
(74) *Attorney, Agent, or Firm*—G. Donald Weber, Jr.

(57) ABSTRACT

A weight plate for use with physical fitness equipment is disclosed including a plate body with a central and two outwardly throughbores. The body additionally has an internal bore within the thickness of the plate body which intersects the central throughbore. A selector pin is movably mounted within the internal bore to selectively engage the plate body to a center post. A toggle lever is mounted in the plate to selectively position the selector pin.

8 Claims, 2 Drawing Sheets

WEIGHT PLATE WITH EXTERNALLY ACTUATED INTERNAL LOCKING DEVICE

BACKGROUND

1. Field of the Invention

The invention relates to body building equipment, in general, and, more particularly, to a weight plate having an external toggle lever which actuates an internal mechanical pin to conveniently, safely, simply and ease the selection of weight plates in an exercise apparatus.

2. Prior Art

Bodybuilding equipment (also referred to as physical fitness equipment or exercise apparatus) often takes many forms to provide the resistance necessary to tear down muscle tissue during an exercise regime. Contemporarily, many ingenious resistance developing systems or machines have been developed utilizing, for example, systems which incorporate a selectable weight stack. By design, the known equipment allows a user to, within the module, increase weight as the available resistance is incrementally selectable. These systems often promise faster and better results for exercisers. However, and although, history would show the ingenious to the advancement of mechanical and/or biomechanics as it may benefit muscle growth, zero effort has been made to simplify, make safer and contemporizing the selectorized weight stack for over four decades.

Conventional weight stacks are, typically, multiple layers of metallic based plates which collectively and, generally, amass an aggregate gross amount of weight. Generally, a weight stack includes a variety of rectangular weight plates, typically one inch thick and about 10 by 4 inches. Each plate incorporates four bore holes therein. Three throughbores pass vertically through the thickness of the plate from the top surface to the bottom surface. The fourth bore passes horizontally within the width of the plate (between the top and bottom surfaces) and intersects the middle one of the three bore holes. Two throughbores engage or receive a pair of spaced-apart guide rods and cause the plate to track vertically thereon. The middle throughbore accommodates a further rod or center post. The center post has multiple diametric throughbores to act as a recipient for a selector pin which passes through the fourth throughbore. Thus, each plate may be independently selected by way of manually inserting a selector pin which is, typically, slightly longer than the width of a plate and has a knob of sorts on one end so that a user may better manipulate the selector pin. The pin is inserted through the fourth throughbore in the plate and a throughbore in the center post to lock the weight plate to the center post when moving it vertically either up or down.

Although traditional weight stacks, such as those described above, have succeeded in carrying out the intended purpose, there are many areas for substantial improvement.

One key problem often associated with traditional weight stacks is that the removable selector pin, is commonly misplaced, stolen or damaged whereupon it is replaced with a functionally and/or structurally inadequately sized pin. This inappropriate replacement historically has caused bodily injury due to the violation of the inherent design of the apparatus.

The removable pin also permits the user to easily modify the operation of the apparatus outside the manufacturer's design criteria for the plates and/or weight stack.

Additionally, there is a level of dexterity and hand-to-eye coordination required to effect the insertion of the selector pin in the horizontal throughbore of the weight and the center post which further limits the true and effective result.

Therefore, the need exists for a more manufacturable weight plate having a construction that minimizes confusion on the part of the user, possibility for misuse or failure, yet retains the convenient exchange of weight with a single finger of a human hand. The weight plate of the present invention satisfies this need.

SUMMARY OF THE INVENTION

The weight plate of the present invention provides a convenient, integrally assembled exterior lever toggle switch for enabling an internal pin to engage or disengage with a single finger of a human hand.

Manufacturing costs to fabricate the weight plate may be minimized by way of steel casting and the elimination of an unnecessary throughbore.

A weight plate for physical fitness equipment is disclosed including a plate body with a central and two outwardly throughbores which pass vertically therethrough. The body additionally has an internal horizontal bore within the thickness of the plate body which intersects the central vertical throughbore. A selector pin is movably mounted within the internal bore to selectively engage the plate body to a center post which passes through the central throughbore. A toggle lever is mounted in the plate to selectively position the selector pin within the internal bore.

DESCRIPTION OF A PREFERRED EMBODIMENT

Figure 1:
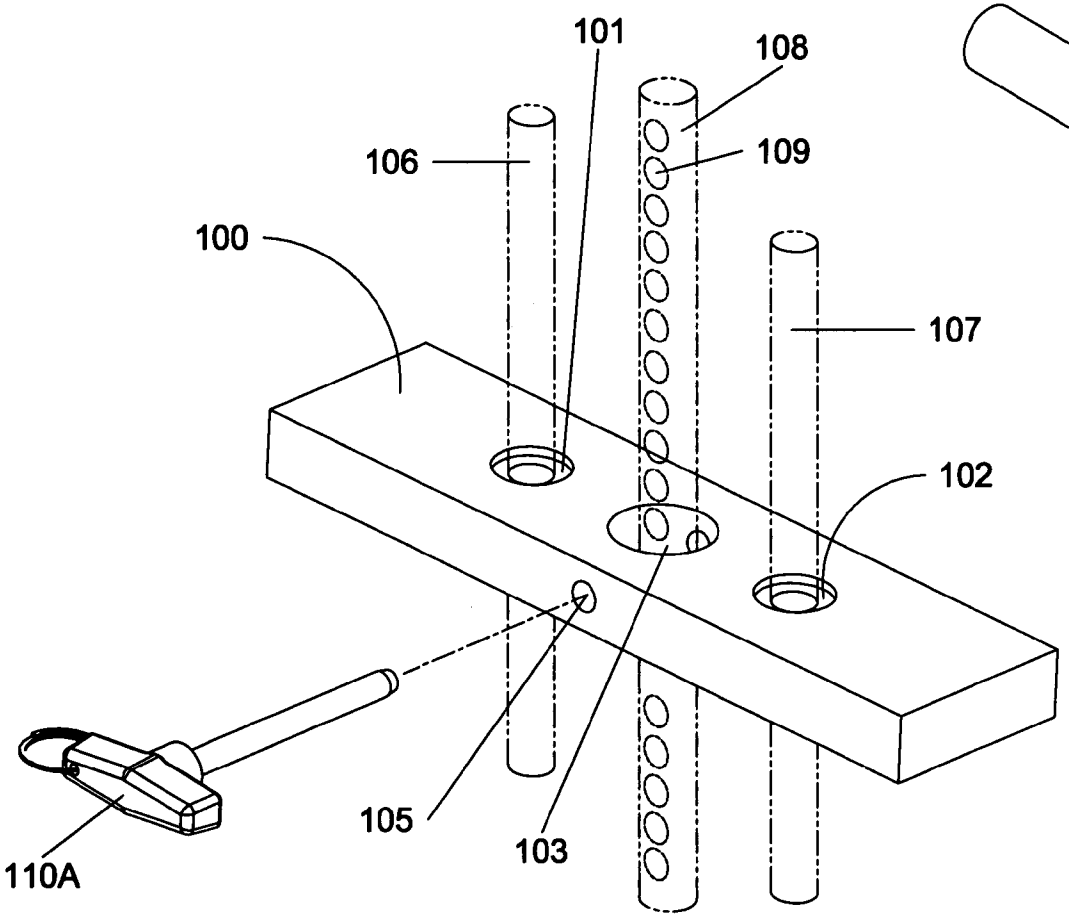
FIG. 1 is a partially exploded, perspective view of a weight plate assembly known in the prior art.

Referring now to FIG. 1, there is shown a conventional weight plate 100 which is known in the art. Typically, multiple layers of metallic based plates are used to collectively amass an aggregate gross weight in a weight machine. Generally, a weight plate 100 comprises a rectangular body, typically one inch thick and about 10 inches by 4 inches. Conventional weight plates incorporate three vertical throughbores 101, 102 and 103 which pass through the thickness of the plate from the top surface to the bottom surface. A fourth throughbore 105 passes horizontally through the width of the plate (from front to back between the top and bottom surfaces) and intersects the middle throughbore 103.

In a typical utilization, throughbores 101 and 102 engage a pair of spaced apart guide rods 106 and 107 (shown in dashed outline). This arrangement permits the plate 100 to track vertically on the guide rods.

The middle throughbore 103 accommodates a center post 108 also shown in dashed outline. The center post 108 has multiple diametric throughbores 109 to act as a recipient for a selector pin 110 which passes through throughbore 105. Each plate 100 may be independently selected by way of manually inserting the selector pin which is, typically, slightly longer than the front-to-back width of any one plate and has a suitable knob 110A at one end so that a user may better manipulate the pin. The pin is selectively inserted through throughbore 105 and a throughbore 109 in the center post 108 (after moving the weights vertically up or down) to select a desired weight plate.

Although conventional weight stacks, such as those described above, have succeeded in carrying out the intended purpose, there are many areas for substantial improvement. For example, the selector pin 110 is frequently misplaced and replaced with a functionally and/or structurally inadequate sized pin. This inappropriate replacement historically has caused bodily injury due to the inherent design and the freedom of user to openly modify its use outside the manufacturers intent and/or the plates (weight stack) design. Additionally, there is a level of dexterity and hand-to-eye coordination required to effect this "engagement" of the selector pin in the throughbore of the weight which further limits the true and effective result.

Figure 2:
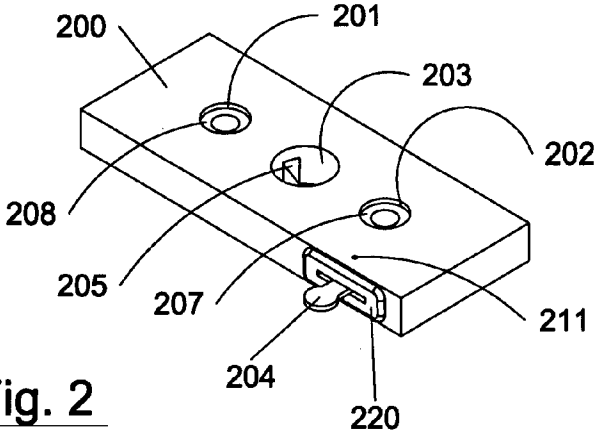
FIG. 2 is a perspective view of the weight plate apparatus of the instant invention.

Referring now to FIG. 2, there is shown the selector weight plate 200 of the instant invention. The selector plate 200 has the traditional rectangular configuration and is formed from a rigid material, such as iron, steel, urethane, rubber, plastic or a composite material. In order to provide a range of plates having varying weight, the dimensional characteristics of the plate often vary. As an example, a ten-pound weight plate may have a dimension of 10 inches long by 4 inches wide by 1 inch thick. These dimensions are illustrative only and are not limitative. The shape and size of the plate are subject to design preference.

The plate 200 is similar to the prior art weight plate formed with a middle throughbore 203 so as to accept a pin receiving adjustment bar (see center post 108 in FIG. 1) and two adjacent throughbores 201 and 202 which include low friction type bearings 206 and 207, respectively. Throughbores 201 and 202 receive the vertical guide bars (see bars 106 and 107 in FIG. 1) which stabilize the selected plate.

The plate 200 is further formed with cavity 205 which permits the insertion and movement of the actuator pin 210 (see FIGS. 3 and 6) when actuated by the external toggle lever 204. The toggle lever 204 is pivoted around swage pin 211 which is inserted into a suitable aperture in the plate 200. The toggle lever 204 is ergonomically designed so that a single finger from a human hand may effortlessly make active or inactive that sector weight plate 200 by engagement with the center post 108.

Figure 3:
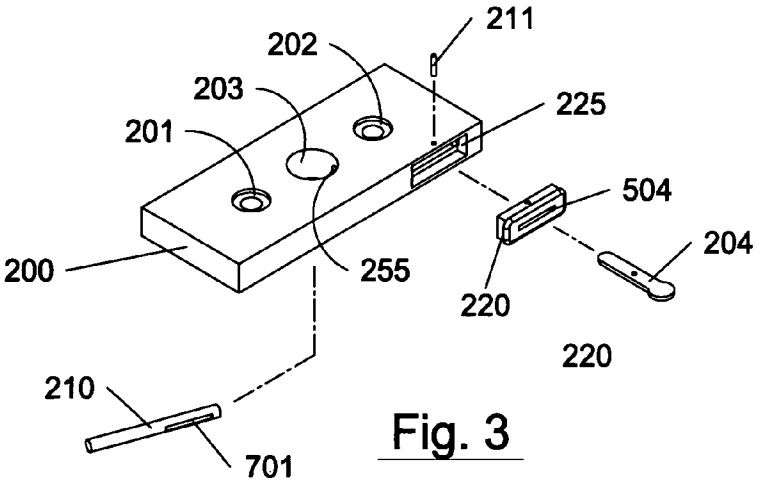
FIG. 3 is an exploded view of the weight plate apparatus shown in FIG. 2.

Referring now to FIG. 3, there is shown an exploded view of the selector weight plate 200 of the instant invention. The selector plate 200 is described supra relative to FIG. 2 with a middle throughbore 203 and two adjacent throughbores 201 and 202 which include low friction bearings 206 and 207, respectively.

The plate 200 is further formed with an internal cavity 225 at the front edge surfaces which permits the insertion of face plate 220 therein. Toggle lever 204 is mounted in slot 504 in the face plate.

The cavity 225 communicates with internal cavity 255 which houses internal selector pin 210. Selector pin 210 includes a slot 701 therethrough for receiving an end of toggle lever 204. The cavity 225 is properly sized to permit movement of the toggle (or pin actuator) lever 204 when actuated at the external end thereof. The toggle lever 204 is pivotally mounted around swage pin 211 which is inserted through suitable apertures in the plate 200 and the face plate 220. The toggle lever is ergonomically designed as described supra.

Figure 4:
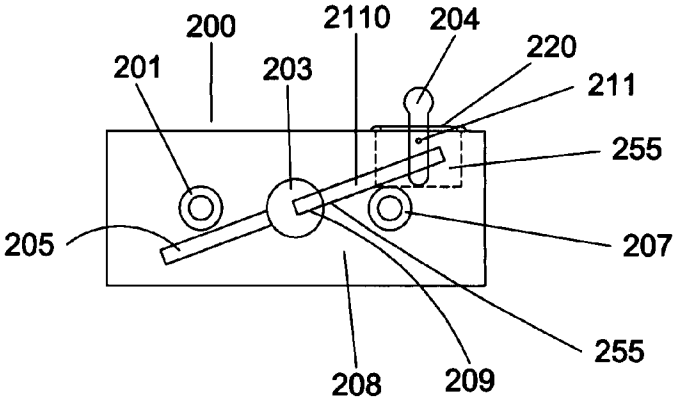
FIG. 4 is a plan view of the bottom surface of the weight plate apparatus of the instant invention.

Referring now to FIG. 4 there is shown a bottom plan view of the weight plate apparatus 200 of the instant invention. The throughbores (or apertures) 201, 202 and 203 are depicted. The open cavity 205 is shown communicating with the central throughbore 203 and is adapted to receive the end of locking pin 210 after it has passed through the appropriate aperture 209 in center column 208. Cavity 205 is also adapted to receive locking pin 210 during assembly of the weight plate 200.

The slot 701 of locking pin 210 is engaged by the inner end of lever 204 (see infra) which is pivotally mounted on swage pin 211 in the face plate 220. When lever 204 is moved to the left (as shown in FIG. 4) in the slot 504 and internal cavity 225, the locking pin 210 is withdrawn from engagement with central rod 208 into cavity 255 whereupon the weight plate 200 is free to move relative to central post 209.

Conversely, when lever 204 is moved to the right (as shown in FIG. 4) in slot 504 and internal cavity 225, the locking pin 210 is passed through aperture 208 to securely engage central post 209 whereupon the weight plate 200 is secured to and inhibited from moving relative to the central post 209.

Figure 5:
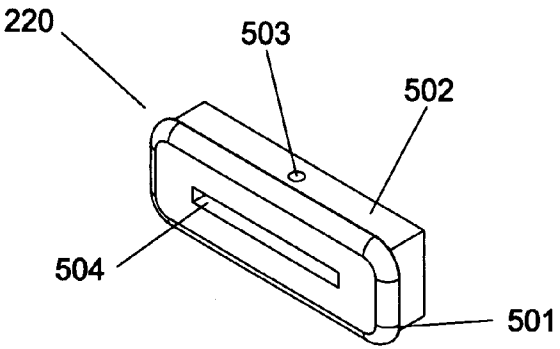
FIG. 5 is an enlarged perspective view of the face plate portion of the weight plate assembly of the instant invention.

Referring now to FIG. 5, there is shown an enlarged representation of the face plate 220 as used in conjunction with the instant invention.

The face plate 220 includes a body 502 as well as an integrally formed front piece 501. The body 502 is inserted into cavity 225 in the front edge surface of the weight plate 200. The front piece 501 is larger than the cavity and is mounted at the front edge surface of the weight plate. The body 502 is largely secured in the weight plate cavity 225 by friction force. The swage pin 211 also passes through the aperture 503 which passes vertically through the body 502 of face plate 220.

The face plate 220 also includes elongated slot 504 which passes horizontally through the front piece 501 and the body 502 and communicates with internal cavity 225. The slot 504 receives the toggle lever 201 as shown and described herein.

Figure 6:
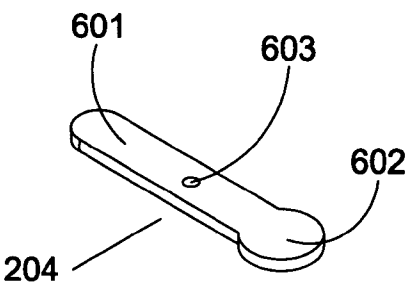
FIG. 6 is an enlarged perspective view of the toggle lever of the weight plate apparatus of the instant invention.

Referring now to FIG. 6, there is shown an enlarged perspective view of the toggle lever 204 used in the instant invention.

The toggle lever 204 is a generally planar component formed of a suitably strong material such as, but not limited to, stainless steel which inhibits rust and corrosion. The toggle lever is somewhat key-shaped with a long planar body portion 601 and a rounded end portion 602 integrally formed together.

An aperture 603 passes through the body portion 601 in a location advantageously selected to permit proper pivotal rotation of the toggle lever around the swage pin 211.

As noted supra, the toggle lever 204 is inserted through the elongated slot 504 in the front panel 220 and engages the slot 701 in locking pin 210. The swage pin 211 passes through the swage pin aperture in the weight body 200 and the swage pin aperture 503 in the face plate 220 and the swage pin aperture 603 in the toggle lever 204. The lever 204 is operative to pivot around the swage pin 211 and within the slot 504 without any vertical play or movement.

Figure 7:
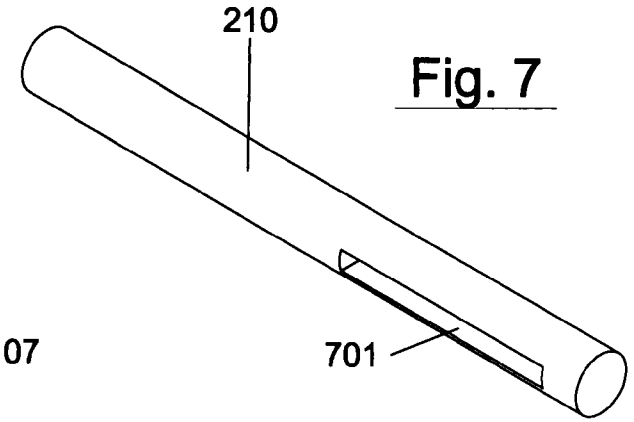
FIG. 7 is an enlarged perspective view of the locking pin of the weight plate apparatus of the instant invention.

Referring now to FIG. 7, there is shown an enlarged perspective view of the interlocking pin 210 shown in FIG.

3. The pin 210 is, typically, made of a strong corrosion resistant material such as, but not limited to, stainless steel. The pin 210 is shown as an elongated rod or shaft and is, typically, cylindrical in shape although other configurations are contemplated.

A slot 701 is formed adjacent one end of pin 210. The slot is arranged to fairly snugly receive the planar end portion 601 of toggle lever 204. Thus, when toggle lever 204 is rotated around the swage pin 211, the pin 210 is moved backward or forward within the cavities 205 and 225 in the weight plate 200 (see FIG. 4). As the pin moves, it is selectively engaged with or disengaged from the throughbore 208 in the center post 209 to lock or unlock the weight plate 200 relative to the center post.

Those skilled in the art will appreciate the many benefits and advantages afforded the present invention. Of significant importance is the ability to easily and safely select weight with a single finger while maintaining the advantage of providing an integrally formed and uniform system to reduce cost and liability exposure to the consumer.

While the invention has been particularly shown and described with reference to the preferred embodiments thereof, it will be understood by those skilled in the art that various changes in form and detail may be made therein without departing from the spirit and scope of the invention.

Thus, there is shown and described a unique design and concept of a weight plate with externally actuated internal locking device. While this description is directed to particular embodiments, it is understood that those skilled in the art may conceive modifications and/or variations to the specific embodiments shown and described herein. Any such modifications or variations which within the purview of this description are intended to be included therein as well. It is understood that the description herein is intended to be illustrative only and is not intended to be limitative. Rather, the scope of the invention described herein is limited only by the claims appended hereto.

The invention claimed is:

1. A weight plate for physical fitness equipment including, a plate body formed with a center bore and two adjacent bores passing vertically through said plate body, an internal bore formed horizontally within said plate body and communicating with said centrally located bore, an engagement pin movably mounted within said internal bore, and a lever adapted to move said pin within said internal bore to positively engage said weight plate to a center post pick up rod which selectively passes through said central bore.

2. The weight plate recited in claim 1 including, a swage pin for pivotally mounting said lever in said plate body.

3. The weight plate recited in claim 1 including, a face plate mounted in the side of said plate body to receive said lever.

4. The weight plate for physical fitness according to claim 1 wherein, said body is formed of a metallic material.

5. The weight plate for physical fitness according to claim 1 wherein, said plate body has no peripherally exposed holes.

6. The weight plate for physical fitness according to claim 1 wherein:

said lever extends outwardly from said plate body so that the finger of a human hand may actuate said lever to either positively engage or disengage plate body.

7. The weight plate for physical fitness according to claim 1 wherein, said plate body is rectilinear in shape.

8. A weight plate apparatus including, a weight plate formed with an internal cavity and an actuating pin mounted within said cavity which pin may be positively engaged or disengaged by an external lever toggle switch which allows such actuating lever to positively control internal mechanical pin locking system, a metallic bar having multiple throughbores wherein, said cavity is sized for slidable receipt of said actuating pin.

* * * * *